US007296306B2

(12) United States Patent
Chou

(10) Patent No.: US 7,296,306 B2
(45) Date of Patent: Nov. 20, 2007

(54) LENGTH-ADJUSTING DEVICE FOR HEAD STRAP OF SWIMMING/DIVING GOGGLES

(76) Inventor: Terry Chou, No. 12, Hsin Ho Herng Rd., Tainan (TW)

( * ) Notice: Subject to any disclaimer, the term of this patent is extended or adjusted under 35 U.S.C. 154(b) by 183 days.

(21) Appl. No.: 11/306,828

(22) Filed: Jan. 12, 2006

(65) Prior Publication Data

US 2007/0157373 A1 Jul. 12, 2007

(51) Int. Cl.
*A61F 9/02* (2006.01)

(52) U.S. Cl. ..... 2/448; 24/170

(58) Field of Classification Search ..... 2/428, 2/430, 448, 426, 338; 24/170, 636
See application file for complete search history.

(56) References Cited

U.S. PATENT DOCUMENTS 5,588,186 A * 12/1996 Ko ..... 24/587.12
5,915,541 A * 6/1999 Beltrani ..... 2/430
6,691,378 B1 * 2/2004 Chou ..... 24/170

* cited by examiner

*Primary Examiner*—Katherine Moran
(74) *Attorney, Agent, or Firm*—Banger Shia

(57) ABSTRACT

A pair of swimming/diving goggles includes a goggle body, a buckle, and a head strap. A wall delimiting a through-hole in the goggle body includes a pressing face. A pin is mounted to the buckle. An end of the head strap extends through the through-hole, a gap between the pin and an inner face of the buckle, and then extending through the through-hole again. When an outer portion of the head strap is pulled and then released, a clamping force provided by an inner portion of the head strap moves the pin to a position in which the head strap is tightly clamped between the pin and the pressing face. When the buckle is moved toward an inner end of the through-hole, a gap between the pin and the pressing face becomes larger to allow loosening of the head strap.

5 Claims, 15 Drawing Sheets

LENGTH-ADJUSTING DEVICE FOR HEAD STRAP OF SWIMMING/DIVING GOGGLES

BACKGROUND OF THE INVENTION

1. Field of the Invention

The present invention relates to a length-adjusting device for a head strap. More particularly, the present invention relates to a length-adjusting device for a head strap of a pair of swimming/diving goggles.

2. Description of the Related Art

A pair of typical swimming/diving goggles includes a buckle mounted to each side of a body of the pair of swimming/diving goggles or to a head strap at a location behind the head of the wearer to allow adjustment of the length of the head strap. FIG. 9 illustrates a pair of swimming/diving goggles using a conventional buckle 1' to adjust the length of a head strap 3'. The rigid buckle 1' includes a connecting portion 11' on an end thereof for connecting with the body 2' of the pair of swimming/diving goggles. A tying portion 12' is provided on the other end of the buckle 1' and includes two posts 121' and 122'. The head strap 3' is wound around the posts 121' and 122' for fixing the length of the head strap 3'. Adjustment of the length of the head strap 3' is not easy, as the user has to loosen the head strap 3' from the posts 121' and 122'. Further, the buckle 1' is separate from the body 2' and thus could not provide an integral appearance. Further, the connecting portion 11' is liable to disengage from the body 2' when subjected to external impact. Further, the rigid buckle 1' is in tight contact with a side of the user's head and thus causes discomfort. FIG. 10 illustrates a buckle for a pair of swimming/diving goggles disclosed in Applicant's U.S. Pat. No. 6,691,378. The buckle comprises a body 4' having a pressing portion 41', a clamping portion 42', and a connecting portion 43' connecting the pressing portion 41' with the clamping portion 42'.

The pressing portion 41' includes a post 411' and a release section 412' on an end thereof. An end of the clamping portion 42' includes a clamping hole 421' through which a head strap 5' extends. A retaining edge 422' is formed on a top edge of each lateral wall delimiting the clamping hole 421' for retaining the head strap 5'.

In assembly, the connecting portion 43' is wound around a body 6' of the pair of swimming/diving goggles, with the pressing portion 41' pressing against an outer side of the body 6'. An end of the head strap 5' is extended through the clamping hole 421' and wound around the post 411' and then extended out of the body 6' via the clamping hole 421'. The distal end of the head strap 5' can be pulled until the required tightness and length of the head strap 5' are obtained, as shown in FIG. 11.

Referring to FIG. 12, when loosening the head strap 5', the pressing portion 41' is moved until the post 411' is disengaged from the retaining edge 422'. An inner portion 52' of the head strap 5' can be moved to loosen the head strap 5'.

Although the buckle of FIGS. 10-12 allows easy adjustment and provides stable clamping, the buckle body 4' is separate from the body 6' of the pair of swimming/diving goggles and thus could not provide an integral appearance. Further, the inner side of the clamping portion 42' of the buckle body 4' is in tight contact with a side of the user's head and thus causes discomfort.

FIGS. 13-15 illustrate a pair of swimming/diving goggles disclosed in U.S. Pat. No. 6,446,272. The pair of dimming/diving goggles comprises a pair of lens parts 71', a pair of lens frames 72', two separate buckle assemblies, and an elastic strap 75'. Each buckle assembly includes a buckle body 73' having a strap-supporting portion 731' around which the strap 75' is wrapped, and a slider 74' which is slidable between a first position (see FIG. 14) and a second position (see FIG. 15) with respect to the strap-supporting portion 731'. When the slider 74' is moved toward the buckle body 73', a strap-pressing piece 741' of the slider 74' presses against the strap 75', and an end 742' of the strap-pressing piece 741' is engaged with a transverse ridge 751' on the strap 75', as shown in FIG. 14. On the other hand, when the slider 74' is moved away from the buckle body 73', the strap-pressing piece 741' no longer presses the strap 75' and thus allows adjustment to the length of the strap 75', as shown in FIG. 15.

The strap 75' is fixed by moving the slider 74' inward. However, when an excessive pulling force is applied to the strap 75', the slider 74' slides and thus could not provide a reliable pressing/positioning effect to the strap 75'. Further, the buckle body 73' and the slider 74' are separate from each other and have to be coupled with the lens parts 71' and lens frames 72', resulting in troublesome assembly. Further, the assembled buckle body 73' and slider 74' may be disengaged from the lens parts 71' and lens frames 72' when subjected to impact.

FIG. 16 illustrates a pair of swimming/diving goggles disclosed in Taiwan Utility Model Publication No. M263132. The pair of swimming/diving goggles includes two separate buckle members 81' and 82' for coupling with a body 83' of the pair of swimming/diving goggles. The buckle member 82' includes a transverse rod 821' around which a head strap 84' is wound. The buckle member 81' includes a resilient piece 811' and a positioning block 812' that can be biased by the resilient piece 811' to press against the head strap 84' at an end. The positioning block 812' can be pressed to disengage from the head strap 84' for adjusting the length of the head strap 84'.

However, the head strap 84' could not be reliably positioned when the resilient piece 81" fatigues. Further, troublesome assembling is required, as there are many elements involved. Further, the buckle members 81' and 82' are separate from the body 83' of the pair of swimming/diving goggles and thus could be disengaged from the body 83' when subjected to impact.

SUMMARY OF THE INVENTION

A pair of swimming/diving goggles in accordance with the present invention comprises a goggle body, a buckle, and a head strap. The goggle body comprises an end including a coupling section that has a through-hole. A wall delimiting the through-hole includes a pressing face. The buckle comprises a buckle body including two lateral sides and an inner face. Two lugs respectively extend from the lateral sides of the buckle body. A pin extends between the lugs. A first gap is defined between the pin and an inner face of the buckle body. A second gap is defined between the pin and the pressing face of the goggle body when the buckle is mounted to the goggle body.

The head strap is made of soft material and comprises an end extending from an inner side of the goggle body through the through-hole of the goggle body, the first gap, and then extending back to the inner side of the goggle body via the through-hole, with the head strap including an outer portion and an inner portion after assembly.

When the outer portion of the head strap is pulled by a wearer, the head strap is tightened to a head of the wearer, and when the outer portion of the head strap is released, a clamping force provided by the inner portion of the head strap moves the pin to a position in which the head strap is tightly clamped between the pin and the pressing face.

When the buckle is moved toward an inner end of the through-hole, the second gap between the pin and the pressing face becomes larger to allow loosening of the head strap. Preferably, the buckle body covers the through-hole.

Preferably, another wall delimiting the through-hole of the goggle body comprises an abutting face. Each of the lugs comprises an abutting face. A space is defined between the abutting faces of the lugs and the abutting face of the goggle body and allows movement of the buckle body.

Preferably, the end of the head strap comprises a first, outer protrusion and a second, inner protrusion spaced from the first, outer protrusion. The second, inner protrusion has a height greater than that of the first, outer protrusion. The first, outer protrusion and the second, inner protrusion flex and pass through the first gap between the pin and the inner face of the buckle body when the end of the head strap is passed through the first gap. The first, outer protrusion only allows slight flexure of the second, inner protrusion and thus prevents the head strap to move in a reverse direction after the second, inner protrusion has passed through the first gap.

Preferably, the head strap further comprises a plurality of teeth.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
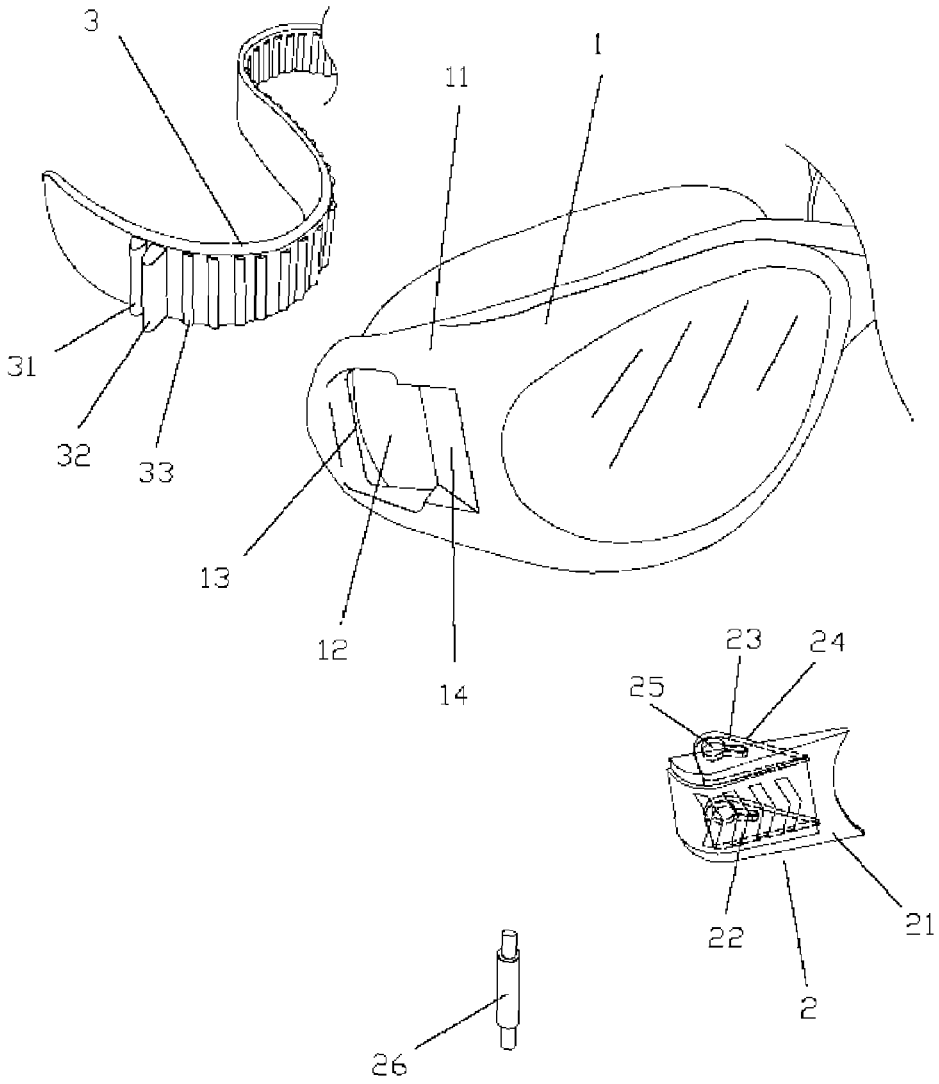
FIG. 1 is an exploded perspective view of a portion of a pair of swimming/diving goggles in accordance with the present invention.

Referring to FIG. 1, a pair of swimming/diving goggles in accordance with the present invention comprises a goggle body 1, two buckles 2 (only one is shown in the drawings), and a head strap 3. The goggle body 1 comprises a coupling section 11 on each of two sides thereof for coupling with an associated one of the buckles 2. Each coupling section 11 comprises a through-hole 12 through which an end of the head strap 3 is extends and folded in two. Two opposite walls delimiting the through-hole 12 respectively include a pressing face 13 and an inclined abutting face 14.

Each buckle 2 is made of rigid material and comprises a buckle body 21 that covers an associated one of the through-holes 12 of the goggle body 1. The buckle body 21 comprises an anti-slide outer face 22. The buckle body 21 further comprises two lugs 23 respectively extending from two lateral sides thereof. The lugs 23 include aligned holes 25 through which a pin 26 extends. Each lug 23 includes an abutting face 24 facing the abutting face 14 of an associated side of the goggle 1. A gap 28 (FIG. 5) exists between the pin 26 and an inner face of the buckle body 21 to allow passage of the head strap 3.

Figure 5:
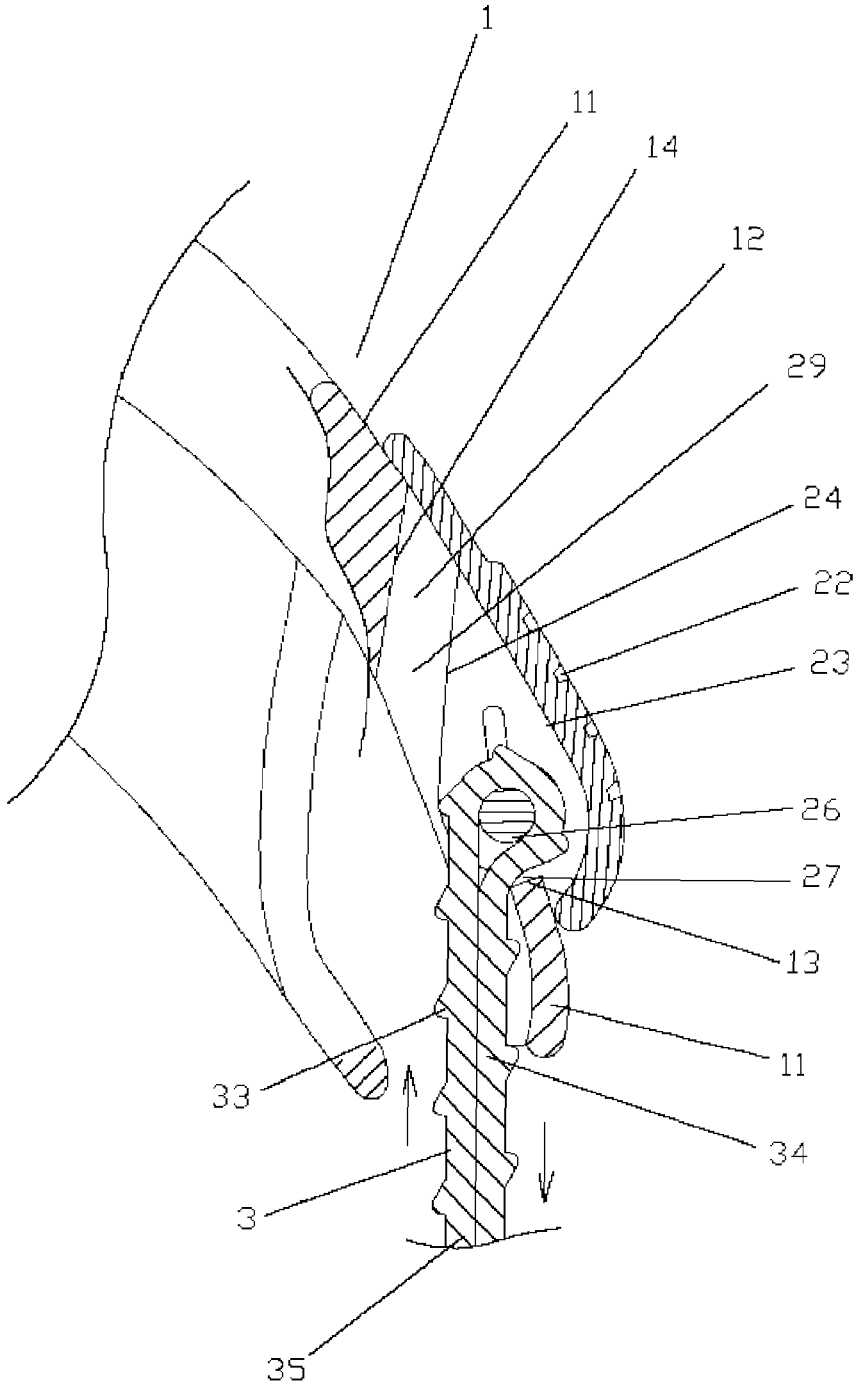
FIG. 5 is a sectional view illustrating adjusting of the length of the head strap.

Referring to FIG. 5, when the buckle 2 is mounted to an associated side of the goggle body 1, a gap 27 (FIG. 5) is extended between the pin 26 and the associated pressing face 13 of the goggle body 1 to allow passage of the head strap 3, and a space 29 (FIG. 5) is defined between the abutting faces 24 of the lugs 23 of the buckle 2 and the associated abutting face 14 of the goggles 1, allowing movement of the buckle 2 in the space 29.

The head strap 3 is made of soft material and includes a first, outer protrusion 31 and a second, inner protrusion 32 on each of two ends thereof. The second inner protrusion 32 is spaced from the first, outer protrusion 31 and has a height greater than that of first, outer protrusion 31. The head strap 3 further includes a plurality of ridges 33 on an outer face thereof.

Figure 2:
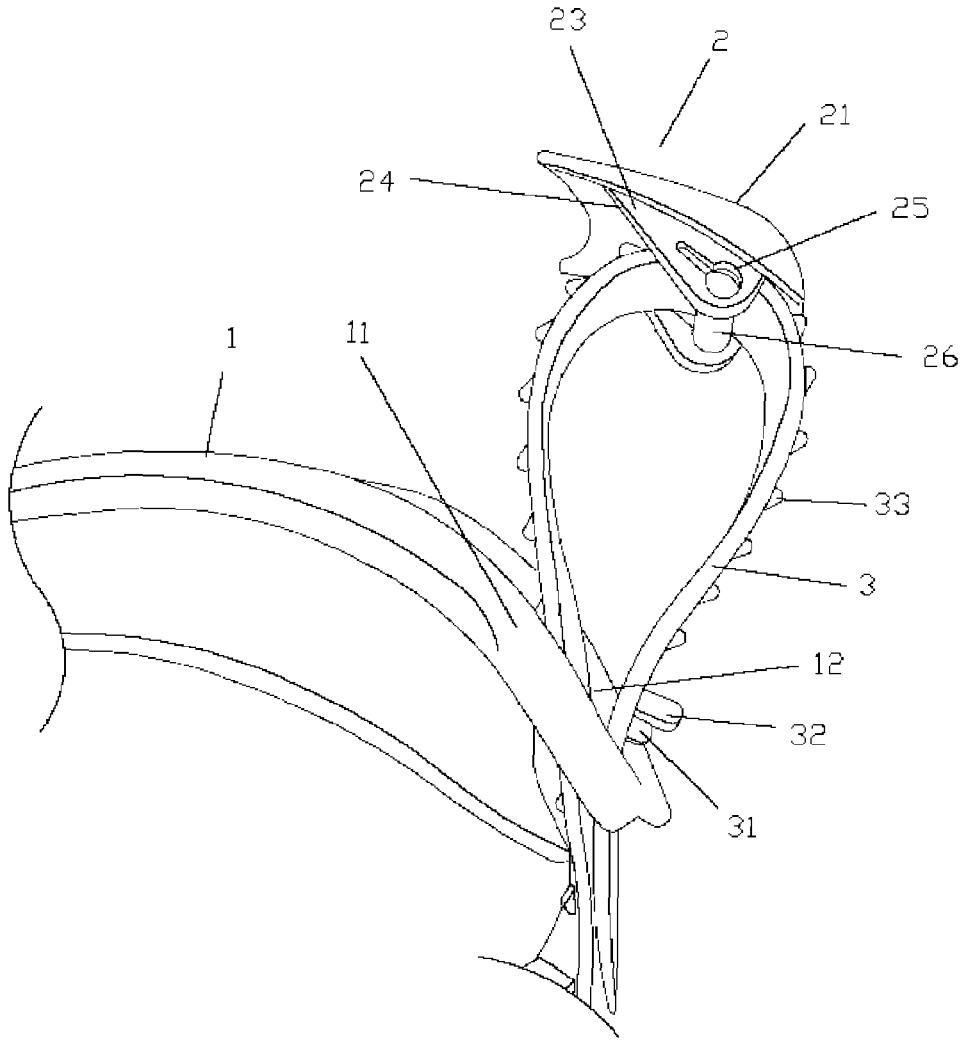
FIG. 2 is a partial top view of a portion of the pair of swimming/diving goggles in accordance with the present invention.
Figure 3:
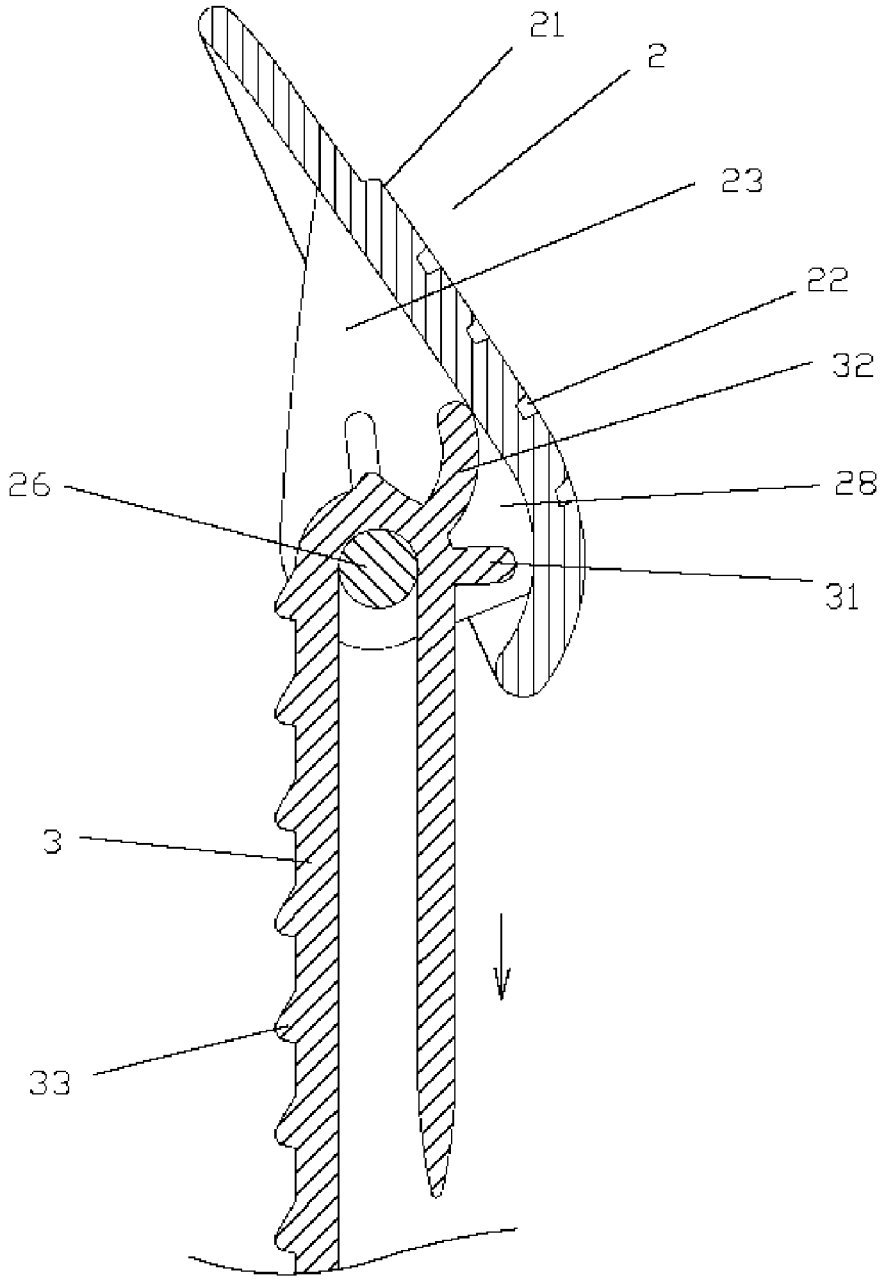
FIG. 3 is a sectional view of a portion of the pair of swimming/diving goggles in accordance with the present invention, illustrating mounting of a head strap to a buckle.
Figure 4:
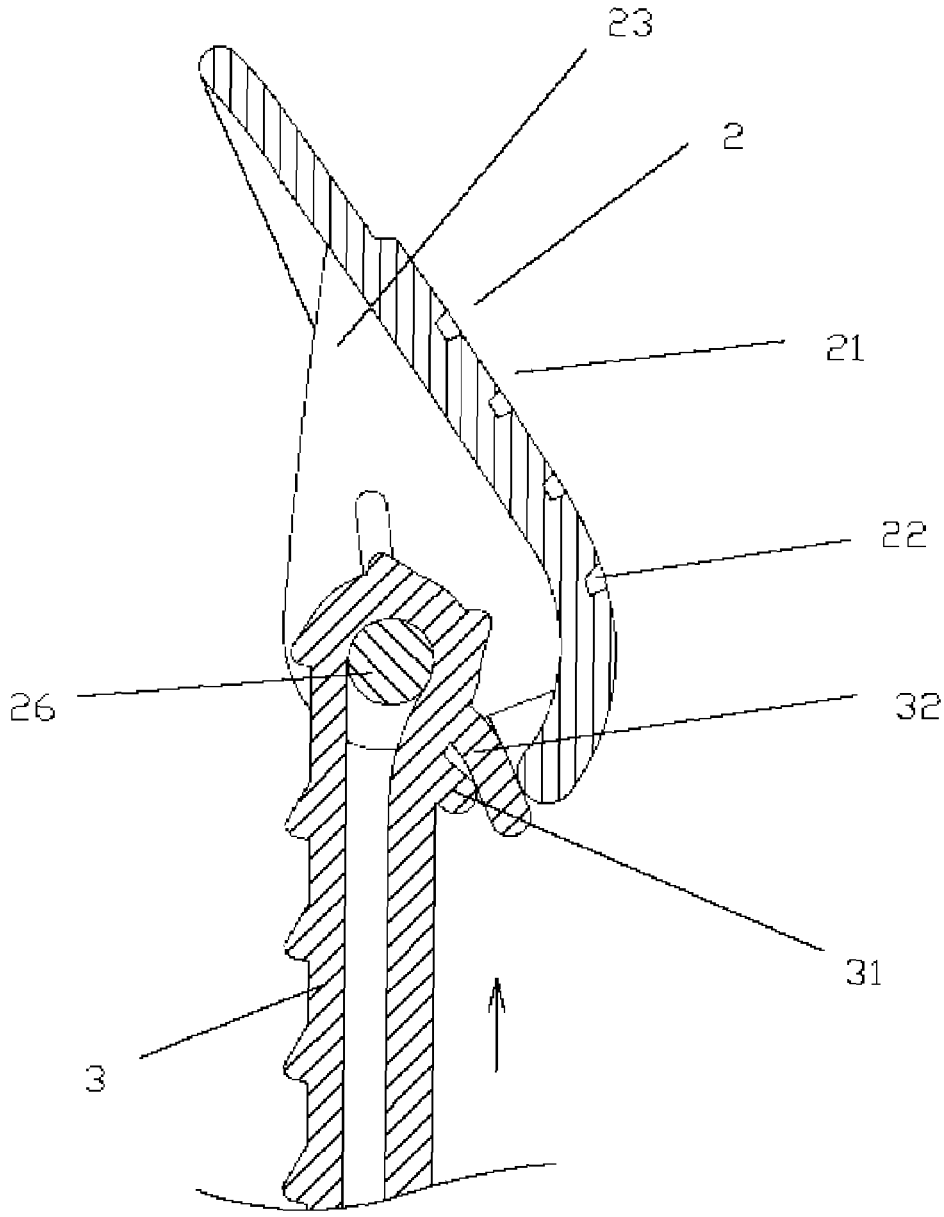
FIG. 4 is a sectional view similar to FIG. 3, illustrating pulling of the head strap in a reverse direction.

Referring to FIGS. 2 through 4, in assembly, an end of the head strap 3 is extended from an inner side of the goggle body 1 through an associated through-hole 12, the gap 28 between the pin 26 of the associated buckle 2 and the inner face of the associated buckle 2 and then extended back to the inner side of the goggle body 1 via the associated through-hole 12. When extending the end of the head strap 3 through the gap 28 between the pin 26 of the associated buckle 2 and the inner face of the associated buckle 2, the protrusions 31 and 32 of the head strap 3 flex and thus pass through the gap 28, as shown in FIG. 3. After the protrusions 31 and 32 have passed through the gap 28, movement of the head strap 3 in the reverse direction is not allowed. This is because the first, outer protrusion 31 only allows slight flexure of the second, inner protrusion 32. Hence, as illustrated in FIG. 4, the second, inner protrusion 32 is stopped by the end face of the buckle body 21 and thus prevents reverse movement of the head strap 3. Improved assembling stability is thus provided.

Referring to FIG. 5, when wearing the pair of swimming/diving goggles in accordance with the present invention, the buckle 2 is moved by the pulling force applied to the head strap 3 to a position covering the through-hole 12 of the goggle body 1. The buckle 2 is not in contact with the head of the wearer, thereby providing wearing comfort. Further, adjustment of the length of the head strap 3 is achieved while pulling an outer portion 34 (FIG. 5) of the head strap 3. The pin 26 may pivot during pulling of the head strap 3 to allow smooth pulling operation.

Figure 6:
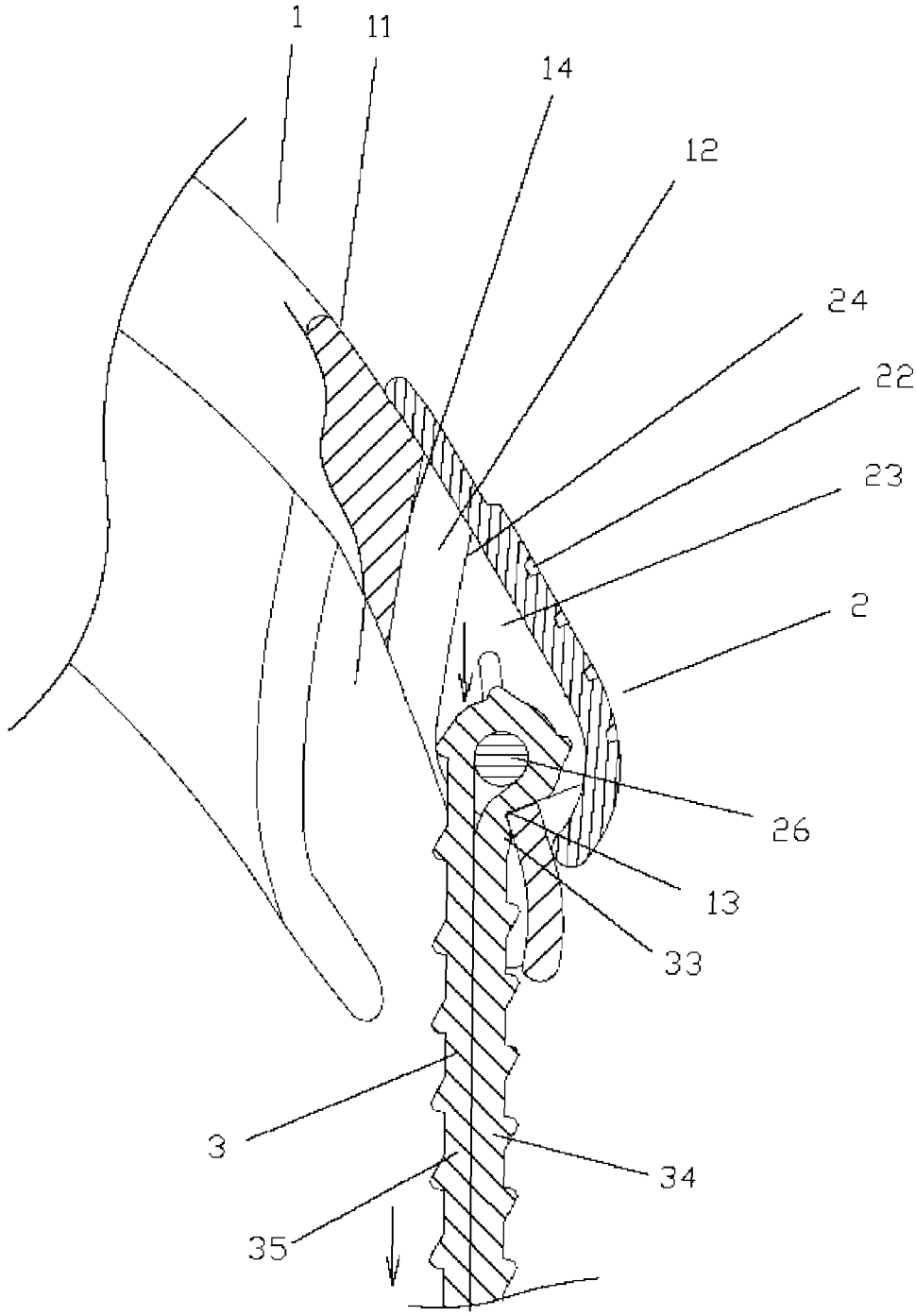
FIG. 6 is a view similar to FIG. 5, wherein adjustment of the length of the head strap is completed.

Referring to FIG. 6, when the outer portion 34 of the head strap 3 is released, a clamping force provided by the inner portion 35 of the head strap 3 moves the pin 26 (and the buckle 2) to move toward an outer end of the through-hole 12 along a direction indicated by the arrow. The head strap 3 is thus tightly clamped between the pin 26 and the pressing sidewall 13 of the goggle body 1 to thereby fix the length of the head strap 3. The teeth 33 of the head strap 3 enhance the clamping effect. The greater the clamping force is, the greater travel of the pin 26 and the buckle 2 has, and the tighter the head strap 3 is clamped. The clamping reliability is thus improved.

In brief, the head strap 3 is tightened to a head of a wearer when the outer portion 34 of the head strap 3 is pulled.

Figure 7:
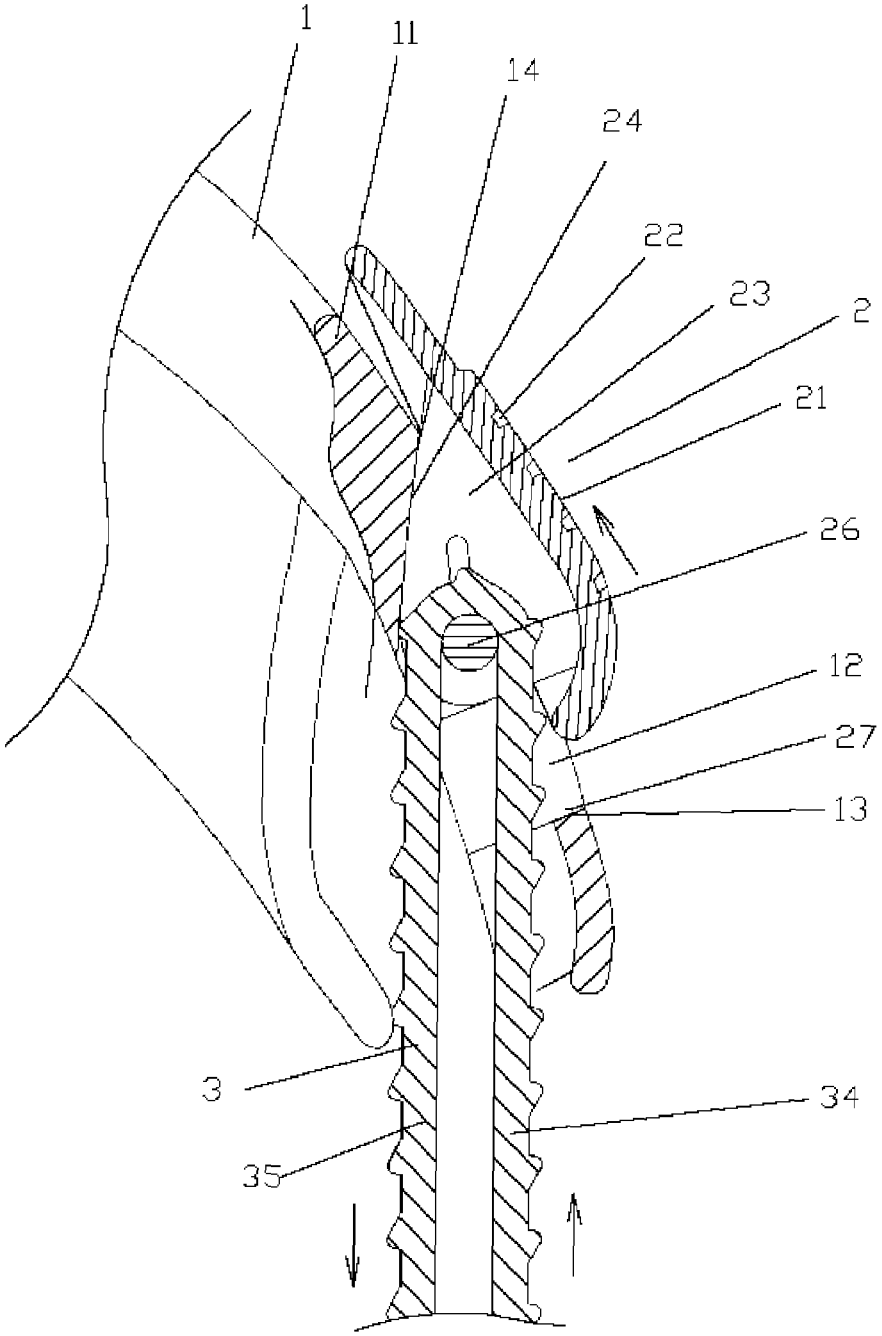
FIG. 7 is a view similar to FIG. 5, illustrating loosening of the head strap.

Referring to FIG. 7, when releasing the head strap 3 is required, the wear moves the buckle 2 toward an inner end of the associated through-hole 12 by the anti-slide outer face 22 of the buckle body 21. Displacement of the buckle 2 is limited by the abutting faces 24 of the buckle 2 and the abutting face 14 of the goggle body 1. The gap 27 between the pin 26 and the pressing face 13 becomes larger and thus allows adjustment of the length (loosening) of the head strap 3 by pulling the inner portion 35 of the head strap 3.

Figure 8:
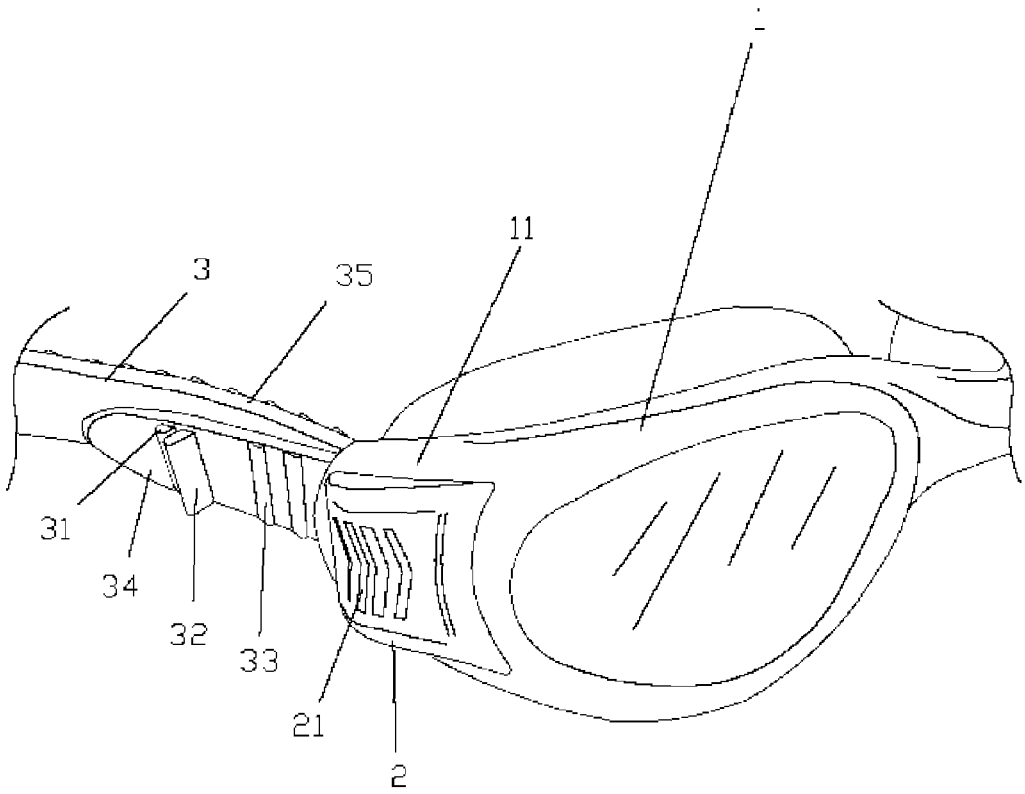
FIG. 8 is a perspective view of a portion of the pair of swimming/diving goggles in accordance with the present invention.
Figure 9:
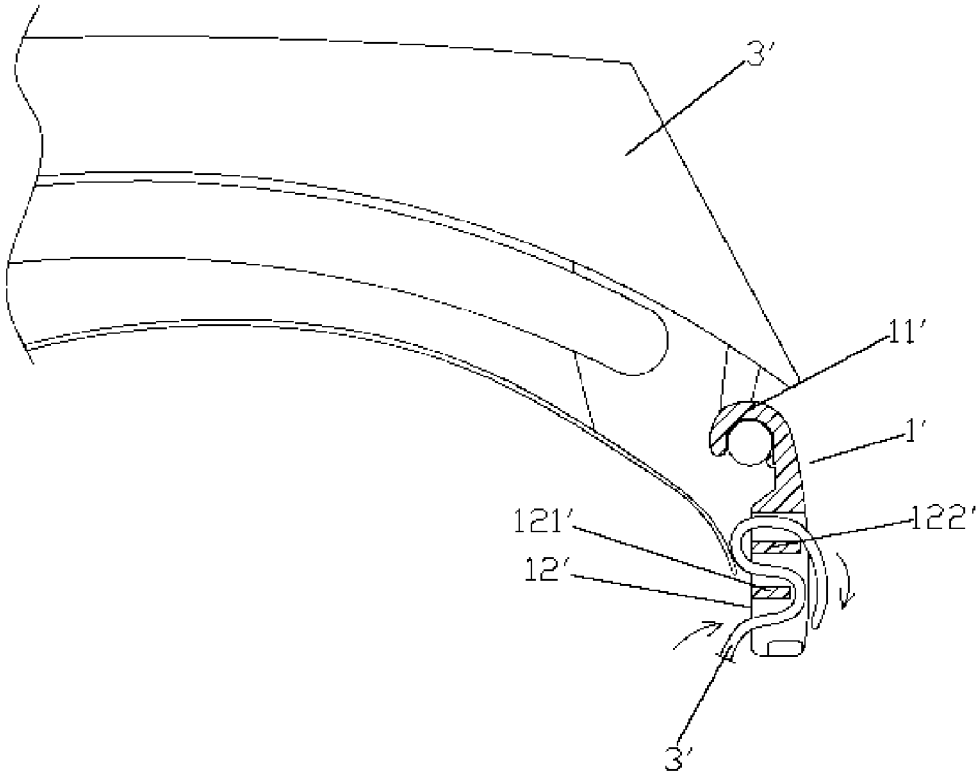
FIG. 9(PRIOR ART)
FIG. 9 is a partial top view, partly sectioned, of a pair of swimming/diving goggles with a conventional buckle for adjusting a length of a head strap.
Figure 10:
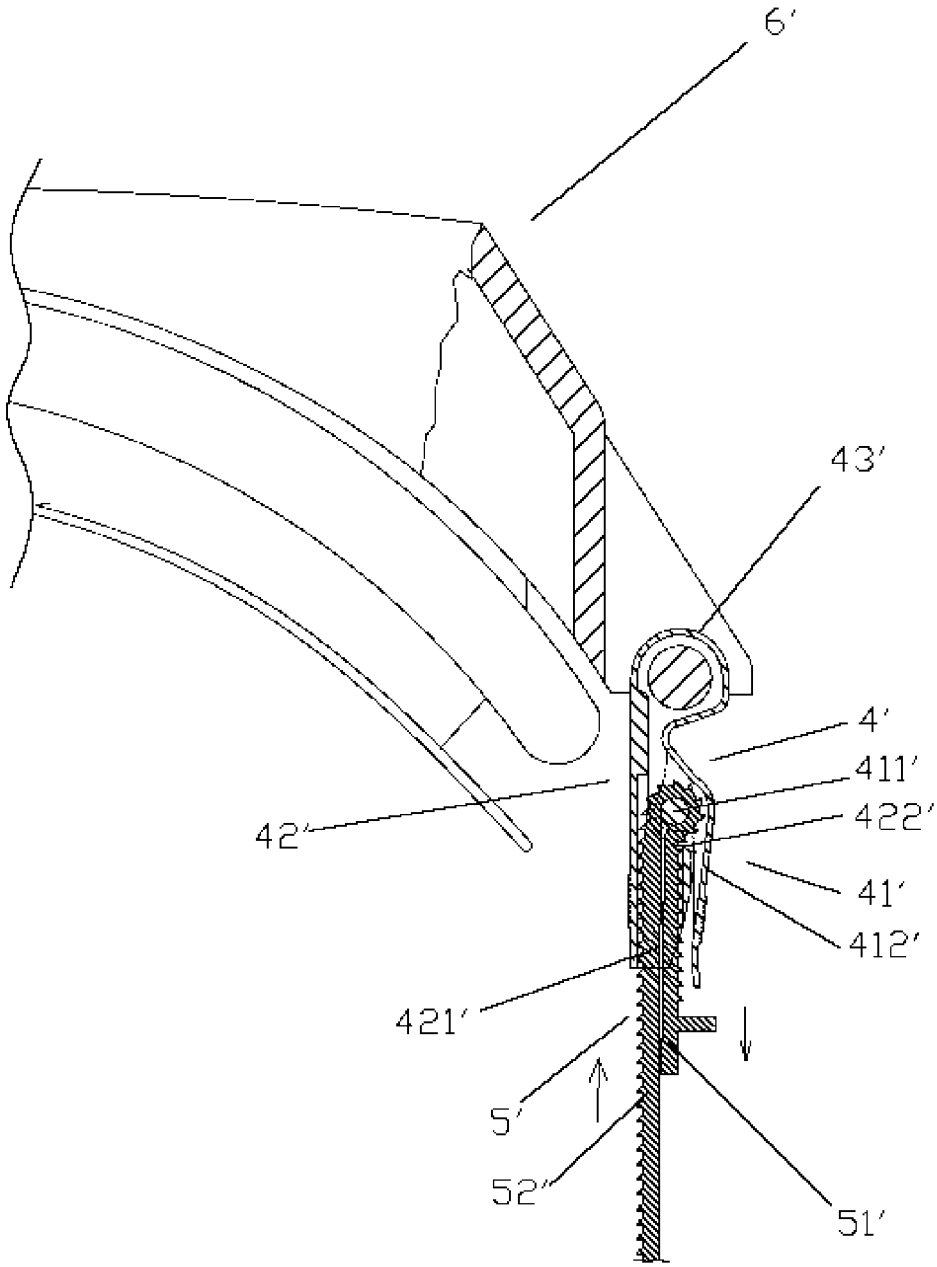
FIG. 10(PRIOR ART)
FIG. 10 is a partial top view, partly sectioned, of a pair of swimming/diving goggles with a buckle disclosed in Applicant's U.S. Pat. No. 6,691,378.
Figure 11:
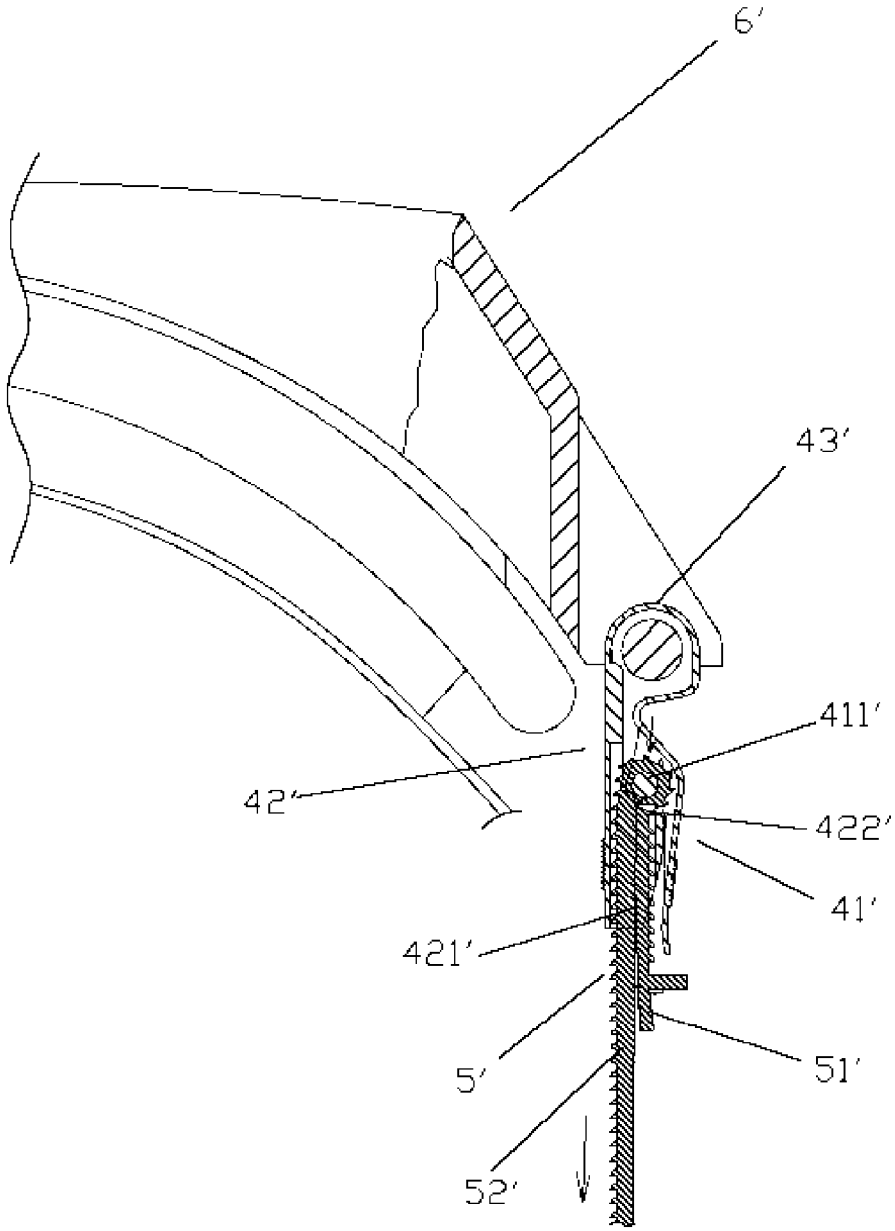
FIG. 11(PRIOR ART)
FIG. 11 is a view similar to FIG. 10, illustrating tightening of the head strap.
Figure 12:
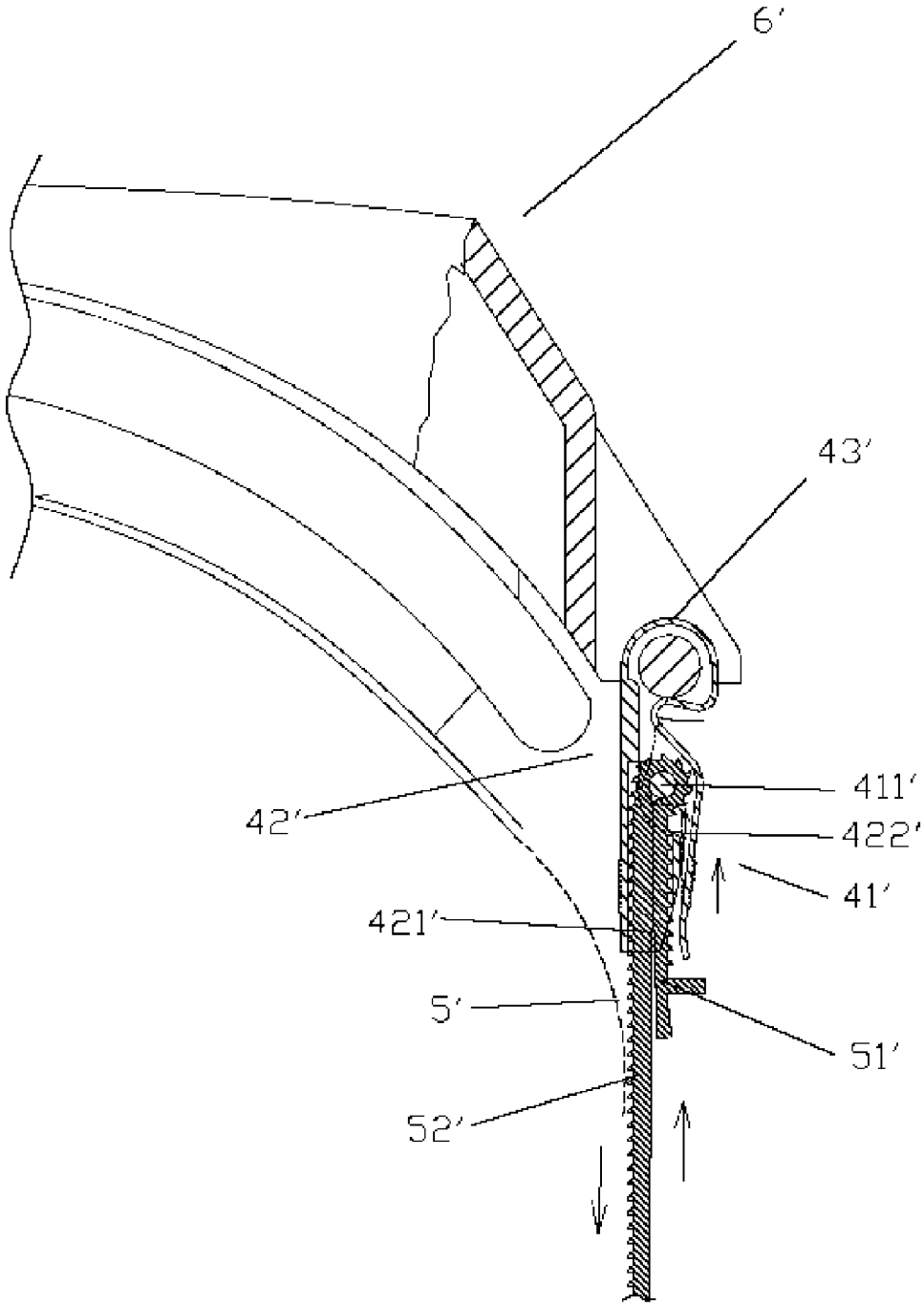
FIG. 12(PRIOR ART)
FIG. 12 is a view similar to FIG. 10, illustrating loosening of the head strap.
Figure 13:
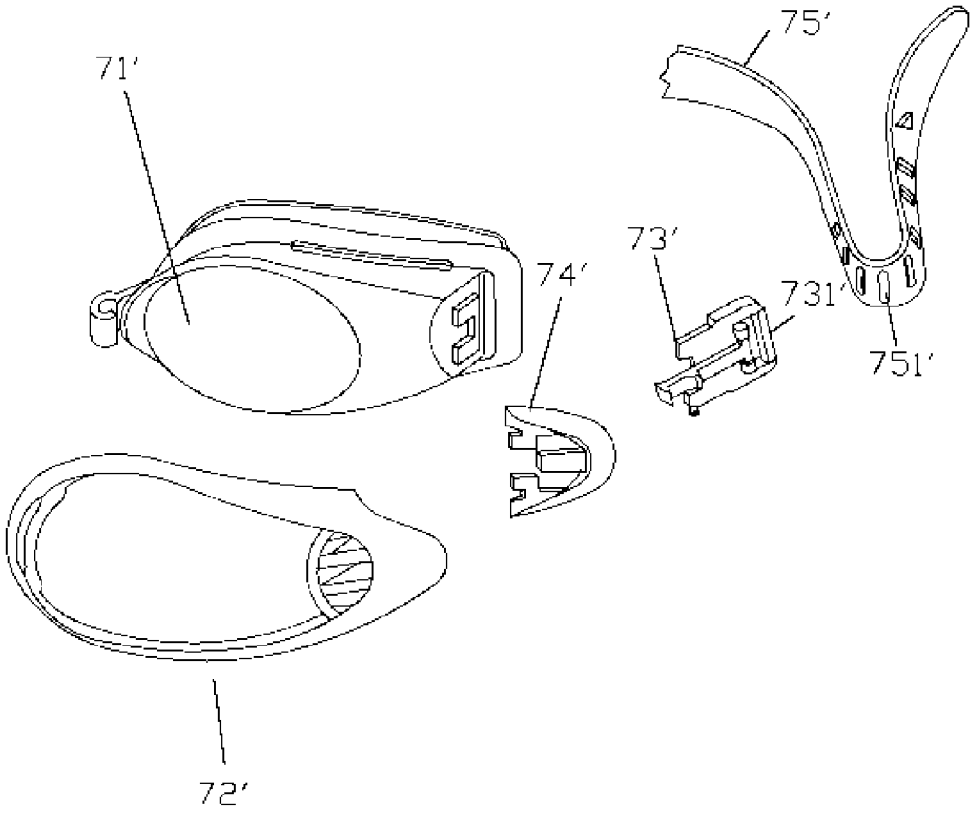
FIG. 13(PRIOR ART)
FIG. 13 is an exploded perspective view illustrating a pair of swimming/diving goggles disclosed in U.S. Pat. No. 6,446,272.
Figure 14:
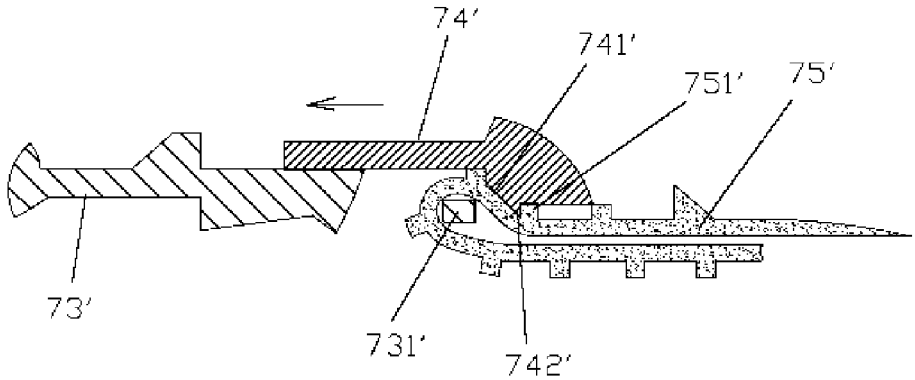
FIG. 14(PRIOR ART)
FIG. 14 is a sectional view illustrating tightening of a head strap of the pair of swimming/diving goggles in FIG. 13.
Figure 15:
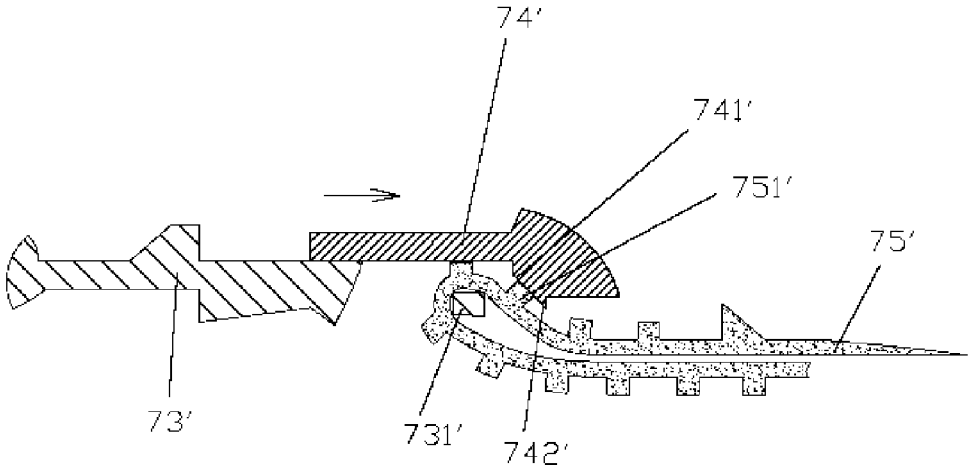
FIG. 15(PRIOR ART)
FIG. 15 is a sectional view similar to FIG. 14, illustrating adjustment of the length of the head strap.
Figure 16:
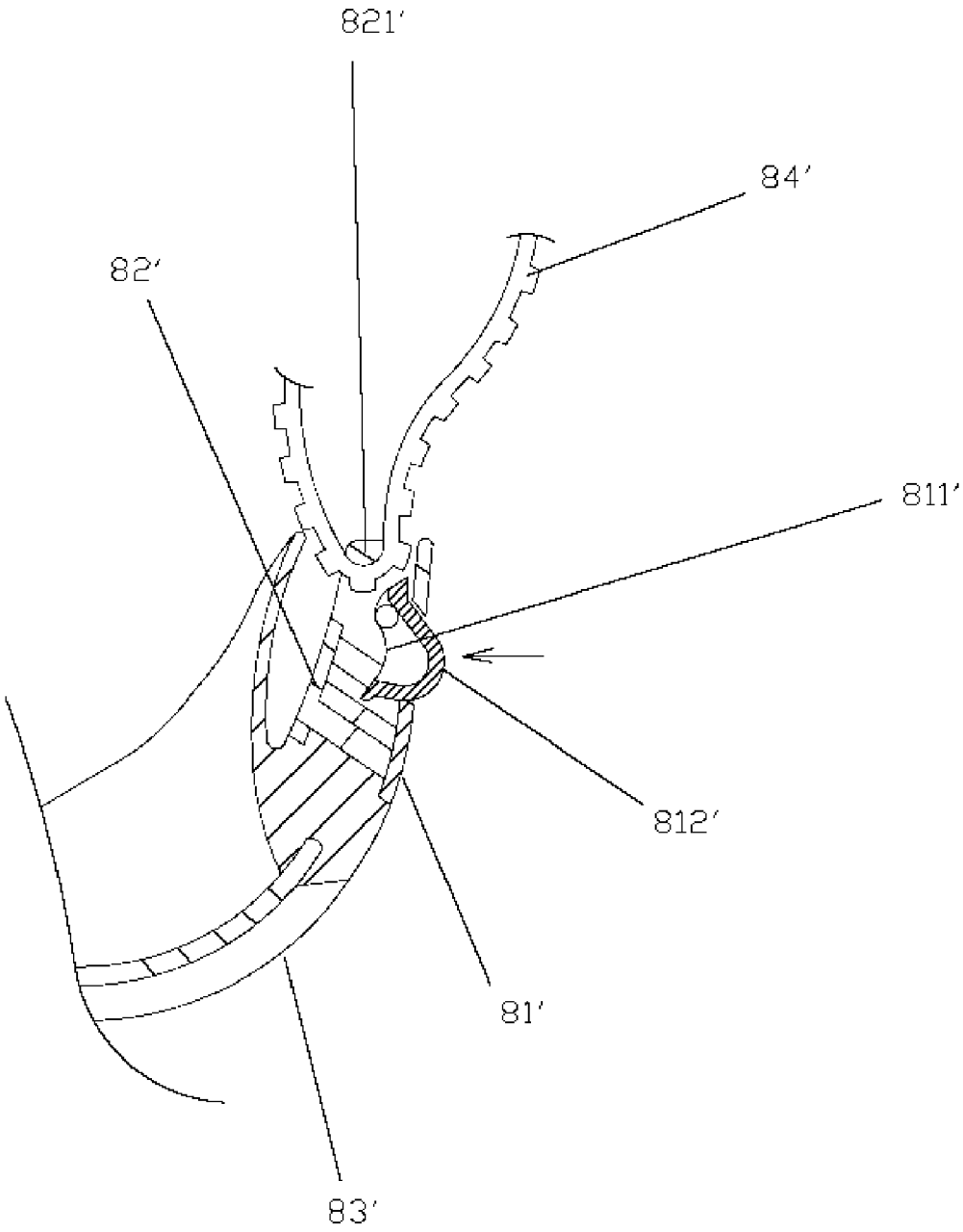
FIG. 16(PRIOR ART)
FIG. 16 is a partial top view, partly sectioned, of a pair of swimming/diving goggles disclosed in Taiwan Utility Model Publication No. M263132.

Referring to FIG. 8, after assembly, the buckle 2 is mounted in the coupling section 11 of the goggle body 1, with the lugs 23 located in the through-hole 12, providing an integral design while preventing the buckle 2 from abutting against the wearer's head. The wearing comfort is improved. Further, the cost of the pair of swimming/diving goggles is cut, as fewer elements are used. Further, disengagement of the head strap 3 and the buckle 2 is difficult after assembly. Namely, the buckle 2 can be reliably mounted to the goggle body 1 while allowing easy adjustment of the length of the head strap 3.

The pin 26 can be fixed between the lugs 23 of the buckle 1 without pivotal movement. Further, the teeth 33 of the head strap 3 can be omitted. Further, the pair of swimming/diving goggle may include only one buckle mounted to only one side of the goggle body 1.

Although specific embodiments have been illustrated and described, numerous modifications and variations are still possible without departing from the essence of the invention. The scope of the invention is limited by the accompanying claims.

What is claimed is:

1. A pair of swimming/diving goggles comprising:

a goggle body comprising an end including a coupling section, the coupling section including a through-hole, a wall delimiting the through-hole including a pressing face;

a buckle comprising a buckle body including two lateral sides and an inner face, two lugs respectively extending from the lateral sides of the buckle body, a pin extending between the lugs, a first gap being defined between the pin and an inner face of the buckle body, a second gap being defined between the pin and the pressing face of the goggle body when the buckle is mounted to the goggle body;

a head strap made of soft material and comprising an end extending from an inner side of the goggle body through the through-hole of the goggle body, the first gap, and then extending back to the inner side of the goggle body via the through-hole, with the head strap including an outer portion and an inner portion after assembly;

wherein when the outer portion of the head strap is pulled by a wearer, the head strap is tightened to a head of the wearer, and when the outer portion of the head strap is released, a clamping force provided by the inner portion of the head strap moves the pin to a position in which the head strap is tightly clamped between the pin and the pressing face; and wherein when the buckle is moved toward an inner end of the through-hole, the second gap between the pin and the pressing face becomes larger to allow loosening of the head strap.

2. The pair of swimming/diving goggles as claimed in claim 1 wherein the buckle body covers the through-hole.

3. The pair of swimming/diving goggles as claimed in claim 1 wherein another wall delimiting the through-hole of the goggle body comprises an abutting face, each of the lugs comprising an abutting face, a space being defined between the abutting faces of the lugs and the abutting face of the goggle body and allowing movement of the buckle body.

4. The pair of swimming/diving goggles as claimed in claim 1 wherein the end of the head strap comprises a first, outer protrusion and a second, inner protrusion spaced from the first, outer protrusion, the second, inner protrusion having a height greater than that of the first, outer protrusion, the first, outer protrusion and the second, inner protrusion flexing and passing through the first gap between the pin and the inner face of the buckle body when the end of the head strap is passed through the first gap, the first, outer protrusion only allowing slight flexure of the second, inner protrusion and thus preventing the head strap to move in a reverse direction after the second, inner protrusion has passed through the first gap.

5. The pair of swimming/diving goggles as claimed in claim 1 wherein the head strap further comprises a plurality of teeth.

* * * * *